219-121
8/23/83 XR 4,400,408 SR

United States Patent [19]
Asano et al.

[11] 4,400,408
[45] Aug. 23, 1983

[54] METHOD FOR FORMING AN ANTICORROSIVE COATING ON A METAL SUBSTRATE

[75] Inventors: Hiroshi Asano, Ichikawa; Takayuki Shimamune, Machida; Toshiki Goto, Fujisawa; Hideo Nitta, Fujisawa; Masashi Hosonuma, Fujisawa, all of Japan

[73] Assignee: Permelec Electrode Ltd., Kanagawa, Japan

[21] Appl. No.: 263,542

[22] Filed: May 14, 1981

[30] Foreign Application Priority Data

May 14, 1980 [JP] Japan ..... 55-62880

[51] Int. Cl.[3] ..... B05D 3/02; B05D 3/12

[52] U.S. Cl. ..... 427/35; 219/121 EF; 219/121 PB; 219/121 LE; 427/125; 427/229; 427/190; 427/191; 427/194; 427/376.3; 427/376.4; 427/376.5; 427/34; 427/53.1

[58] Field of Search ..... 427/125, 190, 191, 194, 427/229, 53.1, 34, 35, 376.3, 376.4, 376.5; 219/121 EF, 121 PB, 121 LE

[56] References Cited

U.S. PATENT DOCUMENTS 2,351,798 6/1944 Alexander ..... 427/229
3,102,044 8/1963 Joseph ..... 427/190
3,293,064 12/1966 Aves ..... 427/229
4,140,813 2/1979 Hund et al. ..... 427/34
4,157,923 6/1979 Yen et al. ..... 427/34
4,172,155 10/1979 Pease ..... 427/34
4,212,900 7/1980 Serlin ..... 427/53.1
4,218,494 8/1980 Belmondo et al. ..... 427/191

*Primary Examiner*—John H. Newsome
*Attorney, Agent, or Firm*—Sughrue, Mion, Zinn, Macpeak & Seas

[57] ABSTRACT

A method for forming an anticorrosive coating on the surface of a metal substrate, which comprises, in one embodiment, (1) coating the surface of the metal substrate with an anticorrosive metal capable of forming an alloy with the substrate metal and/or a hydride of the anticorrosive metal; (2) heating the coated surface, and then; (3) heating the coated surface in a vacuum or in an atmosphere substantially inert to the metal coating and the metal substrate by irradiating the coated surface with electron beams, laser beams or a plasma arc to sinter the coated metal and form an alloy layer in the interface between the metal substrate and the metal coating and, in another embodiment, subsequent to Step (2) and prior Step (3) above, coating the coated surface with a solution of a thermally decomposable platinum-group metal compound and then heating the resulting coated surface at about 40° C. to about 600° C.

9 Claims, No Drawings

METHOD FOR FORMING AN ANTICORROSIVE COATING ON A METAL SUBSTRATE

FIELD OF THE INVENTION

This invention relates to a method for forming an anticorrosive metal coating on the surface of a metal substrate.

BACKGROUND OF THE INVENTION

Metallic materials are used as elements, alloys or as composites in various mechanical devices, chemical devices, etc., depending on their physical and chemical properties. When they are used as parts which need to be corrosion resistant, only the surface of such parts needs to have sufficient corrosion resistance. It has been the practice, therefore, to coat the surface of a metal substrate with a material having superior corrosion resistance.

For example, it is known that titanium exhibits excellent corrosion resistance by forming a passive oxide film on the surface thereof. Thus, titanium has recently gained acceptance as a material for various machines, appliances and instruments such as chemical devices. In particular, in electrolysis apparatuses for sea water, brine, etc., pure titanium has been used widely as a material for an electrolytic cell or a substrate of an insoluble metallic electrode. However, since titanium is expensive, development of a method which permits a less expensive metal substrate to be covered with a thin titanium layer has long been desired. As such, however, crevice corrosion, etc., still tends to occur with pure titanium. The corrosion resistance of pure titanium is still not sufficient when titanium is used as an electrode substrate in electrolysis of strongly acidic electrolytic solutions containing hydrochloric acid, sulfuric acid, etc.

Attempts have, therefore, been made to coat the surface of the titanium with a platinum-group metal, such as palladium, or a platinum-group metal alloy, or with anticorrosive metals such as tantalum or niobium and alloys thereof.

Various methods to form a coating of an anticorrosive metal on the surface of a metal substrate have been proposed. For example, Japanese Patent Publication No. 415/1968 and Japanese Patent Application (OPI) No. 19672/1975 disclose a method for preventing crevice corrosion by bonding a titanium-palladium alloy material to a titanium substrate by welding or the like. Bonding by welding, however, requires a high level of welding skill. It is difficult, therefore, to apply this method to materials with a complex profile, and the strength of adhesion of such a material to the substrate is not entirely satisfactory.

On the other hand, various methods are known for depositing an anticorrosive material on the surface of a metal substrate by electroplating, chemical (electroless) plating, thermal decomposition, spraying, powder calcination, vacuum decomposition, etc., to coat the surface with such a material, and heat-treating the coated substrate (see, for example, Japanese Patent Publication Nos. 12882/1971, 2669/1973 and 24136/1973, and Japanese Patent Application (OPI) Nos. 25641/1973, 143733/1975, 4736/1978 and 18433/1978).

According to these methods, the thickness of the coating can be made as thin as is required. However, formation of micropores in the coated layer cannot be avoided, and heat-treatment must be performed in a vacuum, etc., for a long period of time. Because of these difficulties, prior art methods have not been able to provide products having a high degree of corrosion resistance and satisfactory adhesion of the coated layer to the substrate.

SUMMARY OF THE INVENTION

A major object of this invention is to overcome the above-described difficulties of the prior art, and to provide a method for easily forming a compact anticorrosive metal coating having high adhesion and excellent corrosion resistance on the surface of a metal substrate.

This invention, therefore, provides a method for forming an anticorrosive coating on the surface of a metal substrate, which comprises:

(1) coating the surface of the metal substrate with a powder of an anticorrosive metal capable of forming an alloy with the substrate metal and/or a powder of a hydride of the anti-corrosive metal;
(2) heating the coated surface; and then
(3) heating the coated surface in a vacuum or in an atmosphere substantially inert to the metal coating and the metal substrate by irradiating the coated surface with electron beams, laser beams or a plasma arc to sinter the coated metal and form an alloy layer in the interface between the metal substrate and the metal coating.

Additionally, this invention provides a method for forming an anticorrosive coating on the surface of a metal substrate, which comprises:

(1) coating the surface of the metal substrate with a powder of an anticorrosive metal capable of forming an alloy with the substrate metal and/or a powder of a hydride of the anticorrosive metal;
(2) heating the coated surface;
(3) coating the coated surface with a solution of a thermally decomposable platinum-group metal compound;
(4) heating the resulting coated surface at about 40° to about 600° C.; and then
(5) heating the coated surface in a vacuum or in an atmosphere substantially inert to the metal coating and the metal substrate by irradiating the coated surface with electron beams, laser beams or a plasma arc to sinter the coated metal and form an alloy layer in the interface between the metal substrate and the metal coating.

DETAILED DESCRIPTION OF THE INVENTION

This invention produces the particular advantage that a firmly adherent anticorrosive metal coating with sufficient corrosion resistance can be easily formed on the surface of a metal substrate which has insufficient corrosion resistance by forming an alloy layer in the interface between the metal substrate and the metal coating.

Furthermore, in accordance with this invention, since the coating of an anticorrosive metal is performed by a powder coating method and the sintering and heat treatment are performed using a high-energy source such as electron beams, high melting metals having a melting point of about 2,500° C. or more, such as tungsten, molybdenum, tantalum and niobium, can be easily employed as a coating material and the coating treatment can be completed within a very short period of time.

The method of this invention, therefore, does not require long term high-temperature heat-treatment as in the prior art methods, and adverse oxidative or thermal effects on the substrate or metal coating can be markedly reduced. Even after assembly of a particular device, a part of the device, as required, can easily be coated using the method of this invention.

The metal coating obtained by the method of this invention is compact and has sufficient corrosion resistance. Furthermore, since the metal coating is formed by a powder sintering method, the coated surface has a moderate degree of roughness and good adhesion to an electrode active substance which subsequently might be coated thereon. Accordingly, the coated metal substrate is especially suitable for use as an electrolysis electrode or an electrode substrate.

Suitable metal substrates which can be used in this invention may be any of those metal materials which are generally used in various apparatuses, appliances and instruments, and there is no particular limitation on the nature of the metal substrate. Exemplary metal substrates include, for example, structural materials, electrically conductive materials, valve metals with corrosion resistance, such as titanium, tantalum, zirconium, and niobium, alloys composed mainly, e.g., containing more than about 50% by weight, of these valve metals, for example, alloys such as Ti-Ta, Ti-Ta-Nb, Ti-Ta-Zr, Ti-Pd, etc., and less expensive metal materials with good workability, such as iron, nickel, cobalt, copper, alloys composed mainly, e.g., containing more than about 50% by weight, of these metals, for example, alloys such as steel, stainless steel, Ni-Cu, brass, etc. When the final coated product is to be used as an electrolysis electrode or a substrate therefore, titanium can be suitably used as an anode, and titanium, iron and nickel can be suitably used as a cathode.

Suitable metals which can be coated on the surface of the substrate metal are any of those metals which have excellent corrosion resistance and can be alloyed with the substrate metal. Exemplary coating metals include tantalum, zirconium, niobium, titanium, molybdenum, tungsten, vanadium, chromium, nickel, silicon, and alloys composed mainly of these metals, for example, alloys such as Ta-Ti, Nb-Ti, W-Ni, W-Mo, etc.

When the anticorrosive coating metal also has electrode activity, the resulting metal-coated product according to this invention can be directly used as an electrode. An example is a cathode for electrolysis of an aqueous solution comprising iron coated with nickel or tungsten. Suitable combinations of the substrate and the coating metal are, for example, a combination of a titanium or zirconium substrate and a tantalum or tungsten coating, and a combination of an iron or nickel substrate and a titanium, tantalum, niobium, zirconium or molybdenum coating or alloy thereof coating.

The coating of the anticorrosive metal on the surface of the metal substrate can be performed by a powder coating method. According to this powder coating method, a powder of the above-described anticorrosive metal as used in powder metallurgy or a hydride of the above-described anticorrosive metal, specific examples of which hydrides are set forth hereinafter, or a mixture thereof is added to a solvent, such as water and an alcohol, e.g., methanol, ethanol, propanol and butanol, together with a binder, such as dextrin, polyvinyl alcohol or carboxymethyl cellulose (CMC), to prepare a mixed solution. The thus-obtained mixed solution is then coated on a metal substrate using known techniques such as brush-coating, spray-coating and immersion-coating. Subsequent heat-treatment causes evaporation of the solvent, decomposition of the binder and organic substances, and decomposition of bonded hydrogen of the metal hydride, and coating and sintering of the anticorrosive metal results. This powder coating method is described in detail in, for example, Japanese Patent Application (OPI) Nos. 25641/1973, 143733/1975 and 118636/1974.

Where the powder of the anticorrosive metal is not easy to use because of oxidation or the like, powders of metal hydrides, such as $TiH_2$, $ZrH_2$, $NbH_x$, $TaH_x$ and $VH_x$, which are easily handled as a powder, are preferably used.

This particle size of the coating metal or hydride thereof preferably is about 0.15 mm or less, e.g., about 0.05$\mu$ to about 0.15 mm, because the smaller the particle size is, the more compact the coating becomes. The thickness of the metal coating suitably ranges from about 0.5$\mu$ to about 1 mm.

After coating of the anticorrosive metal and/or hydride thereof on the metal substrate, the coated surface is heated by irradiation with electron beams, laser beams or a plasma arc to sinter the coating metal and, at the same time, to form an alloy layer between the metal substrate and the coating metal. It is believed that the coated surface is raised to a high temperature in a very short period of time by irradiation with the high energy electron beam, laser beams or plasma arc, resulting in sintering of the metal powder. At the same time, mutual diffusion and melting of metal atoms occurs in the interface between the metal substrate and the coating metal, resulting in the formation of a compact alloy layer and a firm bonding between the metal substrate and the coating metal.

Irradiation with electron beams, laser beams or a plasma arc can be performed using known techniques such as those heretofore used in welding, etc. Suitable irradiation techniques for electron beams, laser beams and a plasma arc are described in D. R. Dreger, "Pinpoint Hardening by Electron Beams", *Machine Design,* 89, Oct. 26, 1978, "Heat Treating in a Flash", *Production,* 56, Nov. 1978, and Gary C. Irons, "Laser Fusing of Flamed Sprayed Coatings", *Welding Journal,* Dec. 30, 1978, pp 29–32. In the method of this invention, such conventional means may be performed with appropriate choices of irradiation conditions such as the intensity of the radiation and irradiation time, which provide the energy required for alloying at the interface, depending on the type of the metal used. In this way, the coated surface can be easily heated to about 1,000° C. to about 2,800° C. For example, the technique described in Japanese Patent Application (OPI) No. 20988/1977 can be used.

The electron beam acceleration voltage usually ranges from about several killovolts (e.g., about 2 KV) to about 200 KV, and the current value ranges from about several milliamperes, (e.g., about 2 mA) to about several amperes (e.g., about 3 A).

Irradiation with laser beams is preferably carried out at an acceleration voltage of from about several hundred watts (e.g., about 100 W) to about several killowatts (e.g., about 5 KW) in a vacuum of about $10^{-3}$ to $10^{-6}$ Torr or in an atmosphere of an inert gas, such as argon, helium, etc.

Irradiation with laser beams is preferably carried out at a current value of about 1 A to about 1 KA at an argon gas pressure of from about 1 $Kg/cm^2$ to about 10

Kg/cm$^2$, and in an atmosphere of argon gas. Helium gas or a vacuum of $10^{-4}$ Torr or more can also be used.

Irradiation with electron beams should be effected in a vacuum e.g., $10^{-4}$ Torr or more or in an inert atmosphere such as of helium, etc.

The terms "vacuum" and "inert atmosphere" as used in this invention denote any atmosphere which does not impede irradiation of electron beams or the like, and does not give rise to any difficulties due to the reaction of gas in the atmosphere with the metal coating during the irradiation treatment. Thus, sometimes, air may be employed and is included within this definition. Preferably, the irradiation of electron beams is in a vacuum of a degree of vacuum of about $10^{-2}$ to $10^{-7}$ Torr.

In one embodiment of the method of this invention, before the coated surface of the metal and/or a hydride thereof formed by the powder coating method is heated by irradiation with electron beams or the like, an additional step is performed which comprises coating a solution of a thermally decomposable platinum-group metal compound on the coated surface and heating this coating to about 40° to 600° C. By performing this additional step, the platinum-group metal compound penetrates into the micropores or interstices present in the metal coating formed by the powder coating method, and the platinum-group metal with corrosion resistance, which results from thermal decomposition and reduction of the platinum-group metal compound by heat-treatment through irradiation with electron beams or the like, is embedded in the metal coating. Thus, the metal coating becomes more compact, and the corrosion resistance of the metal coating is further improved.

Examples of suitable thermally decomposable platinum-group metal compounds which can be used include halogen-compounds or organic compounds of platinum, ruthenium, iridium, palladium or rhodium, e.g., $RuCl_3$, $RuCl_4$, $H_2PtCl_6$, platinum metal resinates (of Pt, Ir, Ru, etc.) or mixtures thereof. These compounds can be used as a solution in a suitable solvent e.g., in ethanol, propanol, butanol, water, etc. Solutions of such compounds are well known and used in manufacturing insoluble metal electrodes. Suitable specific examples are described in detail in Japanese Patent Publication No. 3954/1973 corresponding to U.S. Pat. No. 3,711,385.

In another embodiment of the method of this invention, after the irradiaion with electron beams, laser beams or a plasma arc, if desired, the coated surface can be subjected to a rolling-treatment at a pressure of from about 5 Kg/cm$^2$ to about 200 kg/cm$^2$ by using compression rolls. This rolling-treatment reduces the voids present in the coated metal layer, formed by the powder coating and heat-sintering treatment, thereby increasing the compactness and further improving the corrosion resistance and strength of adhesion. This rolling-treatment is, therefore, particularly useful where a powder having a relatively large particle size is employed in the powder coating. Furthermore, the resulting coated surface becomes smooth, and it is suitable for coating of apparatuses and instruments. Furthermore, by heating using additional irradiation with electron beams or the like after the rolling-treatment, the strength of adhesion and the compactness of the metal coating can be further increased.

The following examples are given to illustrate this invention more specifically. It should be understood that these examples are not in any way intended to be interpreted as limiting the scope of this invention. Unless otherwise indicated herein, all parts, percents, ratios and the like are by weight.

EXAMPLE 1

The surface of a mild steel plate (SS-41)(200×100×2 mm) was degreased and washed with hydrochloric acid. A mixed solutiion of 50 parts by weight of titanium hydride powder having a particle size of 0.044 mm or less, 25 parts by weight of polyvinyl alcohol and 25 parts by weight of water was coated on the above-described cleaned surface in a dry thickness of about 120μ by spraying and then fully heated in a vacuum of about $10^{-4}$ Torr at 500° C. The coated surface was then irradiated with electron beams under the conditions indicated in Table 1 below.

TABLE 1

| Electron Beam Irradiation Conditions | |
|---|---|
| Voltage | 100 KV |
| Current | 15 mA |
| Sample Movement Speed | 0.2 m/minute |
| Irradiation Distance | 1.2 m |
| Electron Beam Diameter | 5 × 20 mm (oval) |

After irradiation with the electron beams, the micropores in the titanium coating layer were reduced, an about 20 to 30μ thick alloy layer was formed in the interface between the mild steel plate and the titanium coating layer, and the titanium coating layer was firmly bonded to the mild steel plate.

The thus-obtained sample was subjected to corrosion resistance testing under the condition shown in Table 2 below. For comparison, a mild steel plate (SS-41) which had not been subjected to this titanium coating treatment was tested for corrosion resistance under the same conditions as above.

TABLE 2

| Corrosion Resistance Test Conditions | |
|---|---|
| Corrosion Solution | 25% Aqueous Solution of Hydrochloric Acid |
| Temperature | 80° C. |
| Time | 10 minutes |

The sample prepared in accordance with this invention showed a weight loss of 7.5 mg/cm$^2$, whereas the comparative sample without the titanium coating showed a weight loss of 58.0 mg/cm$^2$. Thus, the coating of titanium by powder coating and irradiation with electron beams was found to markedly increase corrosion resistance.

EXAMPLE 2

The surface of a commercially available pure titanium plate (100×50×3 mm) was etched with hydrochloric acid, and a mixed solution of 3 parts by weight of titanium hydride powder having a particle size of 2 to 3μ, 47 parts by weight of tungsten powder having a particle size of 2 to 3μ, 1 part by weight of dextrin and 49 parts by weight of water was coated on the etched surface of the titanium plate in a dry thickness of about 50μ by spraying.

The thus-coated surface was subjected to a heat-treatment in a vacuum oven ($10^{-1}$ to $10^{-2}$ Torr) at 700° C. for about 1 hour.

Subsequently, the coated surface was irradiated with electron beams in a vacuum of $10^{-4}$ Torr under the conditions shown in Table 3 below.

TABLE 3

| Electron Beam Irradiation Conditions | |
|---|---|
| Voltage | 12 KV |
| Current | 0.4 A |
| Sample Movement Speed | 10 mm/sec |
| Irradiation Distance | 1.2 m |
| Electron Beam Diameter | 20 mm |

The thus-irradiated surface was subjected to a rolling-treatment at a pressure of 50 Kg/cm$^2$ by using a rolling machine, and it was additionally irradiated with electron beams under the same conditions as indicated in Table 3 above.

The thus-obtained sample according to this invention and a comparative sample, a titanium plate without any coating, were tested for corrosion resistance under the conditions shown in Table 4.

TABLE 4

| Corrosion Resistance Test Conditions | |
|---|---|
| Corrosive Solution | 15% Aqueous Solution of Hydrochloric Acid |
| Temperature | 60° C. |
| Time | 48 hours |

The rate of corrosion of the comparative sample was 0.01 mg/hr/cm$^2$, whereas that of the sample according to this inventin was 0.001 mg/hr/cm$^2$. Thus, these results demonstrate that the coating in accordance to the method of this invention markedly increased corrosion resistance.

EXAMPLE 3

A titanium plate (200×100×1.5 mm) was degreased and washed with hydrochloric acid. A mixed solution of 45 parts by weight of tantalum powder having a particle size of 0.44 mm or less, 5 parts by weight of titanium hydride having a particle size of 0.44 mm or less, 25 parts by weight of polyvinyl alcohol and 25 parts by weight of water was coated on the above-described titanium plate in a dry thickness of about 100μ with a brush. The coated surface was fully dried by heating at 500° C. in a vacuum of about $10^{-4}$ Torr and then irradiated with laser beams under the conditions shown in Table 5.

TABLE 5

| Laser Beam Irradiation Conditions | |
|---|---|
| Beam Output | 500 W |
| Beam Dimension | 10.2 × 0.3 mm |
| Sample Movement Speed | 15 mm/second |

The irradiation with the laser beams was carried out in air. During this irradiation, argon gas was blown onto the coated surface so that the surface metal was not oxidized or protected against oxidation.

Subsequently, the plate was subjected to a rolling treatment at a pressure of 10 Kg/cm$^2$ using a roll machine, and the plate was then irradiated with laser beams under the conditions shown in Table 5 above.

Electron microscopic observation revealed that prior to the irradiation with laser beams of the tantalum and a small amount of titanium-coated titanium plate, the coating layer contained a number of micropores, and the adhesion between the substrate and the coating layer was insufficient.

It was also found that after irradiation with laser beams according to the method of this invention, almost all of the micropores present in the coating layer of the above-obtained coated titanium plate had been eliminated, and the sintering of tantalum and titanium powder, and the formation of an alloy layer in the interface between the titanium substrate and the sintered coating layer were effected sufficiently.

Next, an electrode coating solution having the composition shown in Table 6 below was coated on the above-obtained tantalum-titanium coated titanium plate as an electrode substrate and heated in air at 450° C. to form an electrolysis anode coated with a mixed oxide of a noble metal and a valve metal.

TABLE 6

| Electrode Coating Solution | |
|---|---|
| Iridium Trichloride | 2 g |
| Tantalum Tetrachloride | 1.5 g |
| 10% Aqueous Solution of Hydrochloric Acid | 10 ml |

For comparison, an electrode coating solution having a composition shown in Table 6 above was coated on a titanium plate without a tantalum-titanium coating to form a comparative anode.

The thus-obtained electrolysis anode, produced according to the method of this invention and the comparative anode were subjected to electrolysis testing under the conditions shown in Table 7 below. A carbon plate was used as a cathode.

TABLE 7

| Electroylsis Test Conditions | |
|---|---|
| Electrolyte Solution | 10% Aqueous Solution of Sulfuric Acid |
| Current Density | 15 A/dm$^2$ |
| Temperature | 40-50° C. |

With the comparative sample, an increase in electrolysis voltage was observed after the sample was used in electrolysis for about 12 months, whereas with the anode sample prepared according to the method of this invention, no appreciable increase in electrolysis voltage was observed after electrolysis for about 15 months. Thus, it can be seen that the coated substrate prepared according to this invention has excellent properties as an anode substrate for electrolysis of sulfuric acid.

EXAMPLE 4

The surface of a mild steel plate (SS-41)(200×100×2 mm) was degreased and washed with hydrochloric acid. A mixed solution of 50 parts by weight of niobium hydride powder having a particle size of 0.074 mm or less, 25 parts by weight of polyvinyl alcohol and 25 parts by weight of water was coated on the surface of the mild steel plate in a dry thickness of about 100μ with a brush and fully dried by heating in vacuum of about $10^{-4}$ Torr at 500° C.

The thus-coated surface was irradiated with a plasma arc under the conditions shown in Table 8 below using a plasma torch, and the resulting coated surface was then cold-rolled at a pressure of 5 Kg/cm$^2$.

TABLE 8

| Plasma Arc Irradiation Conditions | |
|---|---|
| Argon Gas Pressure | 2 Kg/cm$^2$ |
| Current | 70–80 A |
| Irradiation Time | 5–10 seconds |

The thus-obtained sample and a mild steel plate (SS-41) without a niobium coating were corrosion resistance tested under the conditions shown in Table 2 of Example 1.

The sample prepared by the method of this invention showed a weight loss of 3.2 mg/cm$^2$, whereas the comparative sample showed a weight loss of 58.0 mg/cm$^2$. Thus, it can be seen that the coating of niobium produced in accordance with the method of this invention markedly increased corrosion resistance.

EXAMPLE 5

A nickel plate (100×50×2 mm) was degreased and cleaned. A mixed solution of 40 parts by weight of titanium powder having a particle size of 0.15 mm or less, 20 parts by weight of titanium hydride having a particle size of 0.044 mm or less, 20 parts by weight of polyvinyl alcohol and 20 parts by weight of water was coated on the cleaned surface of the plate in a dry thickness of about 100$\mu$ using a brush.

The thus-coated surface was fully heated in a vacuum at about 500° C., and a platinum-group metal compound solution having the composition shown in Table 9 below was then coated on the coated-surface by spraying and fully dried at about 50° C.

TABLE 9

| Platinum-Group Metal Compound Solution | |
|---|---|
| Palladium Chloride | 2 g |
| Ethyl Alcohol | 5 g |
| Hydrochloric Acid (20% aq. soln.) | 5 g |

Subsequently, the coated surface was irradiated with electron beams in a vacuum of $10^{-4}$ Torr under the conditions shown in Table 10 below.

TABLE 10

| Electron Beam Irradiation Conditions | |
|---|---|
| Voltage | 80 KV |
| Current | 12 mA |
| Sample Movement Speed | 50 cm/minute |
| Irradiation Distance | 1.0 m |
| Electron Beam Diameter | 2 mm |

The thus-obtained sample was corrosion resistance tested under the conditions shown in Table 4 of Example 2. For comparison, a nickel plate without a coating was tested in the same manner.

With the comparative sample, the rate of corrosion was 0.5 mg/hr/cm$^2$, whereas with the sample prepared in accordance with this invention, the rate of corrosion was 0.005 mg/hr/cm$^2$. Thus this demonstrates that the sample according to this invention has improved corrosion resistance.

While the invention has been described in detail and with reference to specific embodiments thereof, it will be apparent to one skilled in the art that various changes and modifications can be made therein without departing from the spirit and scope thereof.

What is claimed is:

1. A method for forming an anticorrosive coating on the surface of a metal substrate, which comprises:

(1) coating the surface of the metal substrate with a powder of an anticorrosive metal capable of forming an alloy with the substrate metal and/or a hydride of the anticorrosive metal;

(2) heating the coated surface; and then (3) heating the coated surface in a vacuum or in an atmosphere substantially inert to the metal coating and the metal substrate by irradiating the coated surface with electron beams or a plasma arc to sinter the coated metal and form an alloy layer only in the interface between the metal substrate and the metal coating.

2. A method for forming an anticorrosive coating on the surface of a metal substrate, which comprises:

(1) coating the surface of the metal substrate with a powder of an anticorrosive metal capable of forming an alloy with the substrate metal and/or a hydride of the anticorrosive metal;

(2) heating the coated surface;

(3) coating the coated surface with a solution of a thermally decomposable platinum-group metal compound;

(4) heating the resulting coated surface at about 40° C. to about 600° C.; and then (5) heating the coated surface in a vacuum or in an atmosphere substantially inert to the metal coating and the metal substrate by irradiating the coated surface with electron beams or a plasma arc to sinter the coated metal and form an alloy layer only in the interface between the metal substrate and the metal coating.

3. The method as in claim 1 or 2, wherein after irradiation with the electron beams or plasma arc, the method includes subjecting the coated surface to a rolling treatment.

4. The method as in claim 3, wherein after said rolling treatment, the method includes heating the coated surface by irradiating the coated surface with electron beams or a plasma arc.

5. The method as in claim 1 or 2, wherein the metal substrate is titanium, tantalum, zirconium, niobium or an alloy composed mainly of these metals.

6. The method as in claim 1 or 2, wherein the metal substrate is iron, nickel, cobalt, copper, or an alloy composed mainly of these metals.

7. The method as in claim 1 or 2, wherein the anticorrosive metal and/or the hydride of the metal is selected from the group consisting of tantalum, zirconium, niobium, titanium, molybdenum, tungsten, vanadium, chromium, nickel, silicon and hydrides thereof.

8. The method as in claim 2, wherein the platinum-group metal compound is selected from the group consisting of halogen-compounds of and organic compounds of platinum, iridium, ruthenium, palladium and rhodium, and mixtures thereof.

9. The method as in claim 1 or 2, wherein the irradiation of the surface with electron beams or a plasma arc is with an intensity sufficient to form said alloy layer only in the interface between said metal substrate and said metal coating.

* * * * *